US005662266A

United States Patent [19]

Zurecki et al.

[11] Patent Number: 5,662,266

[45] Date of Patent: Sep. 2, 1997

[54] PROCESS AND APPARATUS FOR SHROUDING A TURBULENT GAS JET

[76] Inventors: Zbigniew Zurecki, 344 Village Walk Dr., Macungie, Pa. 18062; John Joseph Kaiser, 3201 Coplay St., Whitehall, Pa. 18052; John Lewis Green, R.D. 3, Box 3463, Palmerton, Pa. 18071

[21] Appl. No.: 368,565

[22] Filed: Jan. 4, 1995

[51] Int. Cl.[6] ..... B05B 17/04

[52] U.S. Cl. ..... 239/8

[58] Field of Search ..... 239/290, 291, 239/418, 423–424.5, 429–431, 543, 1, 8; 427/446; 219/121.33, 121.48, 121.5–121.52

[56] References Cited

U.S. PATENT DOCUMENTS

| | | | |
|---|---|---|---|
| Re. 31,018 | 8/1982 | Harrington et al. | 427/446 X |
| 3,082,314 | 3/1963 | Arata et al. | 219/75 |
| 3,470,347 | 9/1969 | Jackson | 219/76 |
| 3,892,882 | 7/1975 | Guest et al. | 427/34 |
| 4,121,082 | 10/1978 | Harrington et al. | 427/446 X |
| 4,121,083 | 10/1978 | Smyth | 219/76.16 |
| 4,527,718 | 7/1985 | Kingston | 222/603 |
| 4,634,611 | 1/1987 | Browning | 427/423 |
| 4,741,286 | 5/1988 | Itoh et al. | 219/121.48 X |
| 4,826,084 | 5/1989 | Wallace | 239/290 |
| 4,853,250 | 8/1989 | Boulos et al. | 427/446 |
| 4,869,936 | 9/1989 | Moskowitz et al. | 427/423 |
| 5,017,751 | 5/1991 | Brecher et al. | 219/121.48 X |
| 5,154,354 | 10/1992 | Reiter | 239/299 |
| 5,296,670 | 3/1994 | Dorfman et al. | 219/121.48 X |
| 5,396,043 | 3/1995 | Couch, Jr. et al. | 219/121.48 X |
| 5,486,383 | 1/1996 | Nowotarski et al. | 239/291 X |

*Primary Examiner*—Lesley D. Morris
*Attorney, Agent, or Firm*—James C. Simmons

[57] ABSTRACT

Use of a shrouding gas to combine with and protect a turbulent gas jet issuing from an orifice enables control of a gas jet stream composition downstream from the orifice. The natural aspiration rate of the gas jet is used to determine the flowrate of shrouding gas which is introduced around the gas jet in a soft gas cushion which does not disrupt the flow pattern of the gas jet but instead is entrained into the jet stream to the exclusion of ambient gases in the atmosphere. Preferably shrouding gas is replaced at least at the rate at which it is entrained. Apparatus for this process uses a porous shroud, preferably of metal foam, through which shrouding gas flows evenly around the gas jet as it issues from a nozzle orifice. Provision for tangential entry of shrouding gas into a manifold which feeds the porous shroud prevents the shrouding gas from impinging upon the porous shroud and causing uneven flow around the gas jet.

12 Claims, 6 Drawing Sheets

PROCESS AND APPARATUS FOR SHROUDING A TURBULENT GAS JET

FIELD OF THE INVENTION

This invention relates to a process for placing a gas shroud around a turbulent gas jet. In another aspect it relates to a method of protecting a gas jet from the ambient atmosphere. In still another aspect it relates to a method of combining two gas streams in desired proportions. In yet another aspect it relates to apparatus for protecting or modifying the composition of a turbulent gas jet.

BACKGROUND OF THE INVENTION

Compressed gas released into a gaseous ambience through a nozzle or orifice forms a fast moving jet which quickly aspirates ambient gases and becomes diluted. Aspiration of air or other gases present in the jet environment is observed in the thermal spray-coating industry, industrial combustion heating and melting, oxygen lancing in steelmaking, as well as various thermal management, welding, pumping and painting applications. The extent of aspiration becomes significant for turbulent gas jets characterized by high Reynolds numbers. The results of aspiration can be detrimental or beneficial, depending on application and process requirements. In both cases, however, there is a need to develop an effective method and apparatus to improve control of gas aspirated into a turbulent gas jet.

Aspiration of ambient air poses a very difficult problem in thermal spray-coating operations involving supersonic and subsonic hot jets of relatively inert or reducing gases carrying reactive droplets or particles of metallic or ceramic feed materials which subsequently form coatings or deposits on an impacted surface. In such thermal spray-coating operations, air aspiration results in oxidation of the coating in a manner which can be very detrimental. In order to address this problem, various new designs of plasma, combustion, and electric arc spraying guns have been proposed as have special retrofit attachments for commercially available spraying guns. In general, such attempts have fallen short because they failed to establish criteria for aspiration flowrates which result from the broad range of turbulent gas jets encountered in the industry. Also, many of the proposed design modifications interfered with the flow field of jets produced by the original equipment.

Among the more common proposals to deal with this problem have been structural and external gas shrouding devices, many of which have proven to be impracticable because either they were too large and required too short of a standoff distance for typical shop conditions or they offered only marginal improvement. Although the history of gas shrouding spans over three decades, the problems involved in protecting and modifying gas jets still cry for solutions that have not been forthcoming.

In an early reference on gas shrouding, Arata et al., U.S. Pat. No. 3,082,314 (1963) describe a plasma arc torch for cutting or welding having a concentric gas shield to reduce electrode erosion and control temperature. Somewhat later and more relevant to the situations discussed above, Jackson, U.S. Pat. No. 3,470,347 (1969) deals with the problem of keeping oxygen away from a coating applied to a substrate with a plasma arc torch. This is said to be accomplished by protecting the torch gas effluent by surrounding it with a forward flowing coaxial annular shield of gas having a width and flow rate corresponding by formula to the torch orifice diameter. Although it is stated that the arc amperage and arc gas flow rate have a negligible effect on the shielding effectiveness, as a practical matter from the information supplied, it is not possible to scale up the operation or adapt it to different types of plasma, arc-wire or combustion spraying guns and burners.

Guest et al., U.S. Pat. No. 3,892,882 (1975) describe a plasma spraying operation in which a zone of sub-atmospheric pressure is maintained through which the spray jet and entrained coating powder pass on the way from the nozzle to the work piece. The sub-atmospheric pressure can be produced by injecting a sheath of gas moving in a spiral path along the inner surface of a tube surrounding the jet spray path, or by a vacuum pump. The disclosed long shielding tubes are impractical in many robotics and manual spray-coating operations that can accept only compact or recessed attachments to the gun nozzle and are unacceptable for burners jetting flames into high temperature furnace chambers.

Smyth, U.S. Pat. No. 4,121,083 (1978) describes a plasma jet spraying device having positioned around the jet opening a wall shroud within which a gaseous flame shroud is formed. This gas shroud is introduced either at an angle to the jet flow or countercurrent or concurrent to the jet flow.

Browning, U.S. Pat. No. 4,634,611 (1987) describes a flame spraying device having the main jet spray shrouded with warm high velocity air in order to increase the velocity of the jet spray beyond the nozzle. Such an air sheath would increase aspiration of oxygen into the jet stream, not reduce it, and, therefore, be counterproductive to the desired protection of an applied coating from oxidation.

Moskowitz, U.S. Pat. No. 4,869,936 (1989) describes a metal shielding attachment for supersonic thermal spray equipment which tangentially introduces a shield gas in a shroud surrounding the gas jet so that the shielding gas has a helical flow path all the way to the work piece. This is intended to address the problem of oxidation of the coating. The attachment uses shield gas nozzles arranged in a circular array adjacent to the jet orifice to inject shield gas tangentially against the inner wall of the shroud, which can be a double walled structure to permit circulation of cooling water within it. This device suffers from the same disadvantages as the apparatus of Guest described in the '882 patent.

More recently, Reiter, U.S. Pat. No. 5,154,354 (1992) discloses what is apparently intended to be an improvement on the device of the '347 patent to Jackson in order to reduce eddying and penetration of the gas shield by surrounding air. This is done by placing a protective gas nozzle with a core hollow space around the spray jet nozzle. The protective gas flow is directed concurrently with the spray jet in a manner said to be free of eddy currents. Although the description of the device is obscure, it is clear that the intent is to accelerate the protective gas mantle as it is introduced around the jet spray. In practice, such devices have fallen short of their objectives.

SUMMARY OF THE INVENTION

We have found that surprisingly good gas shrouding of a turbulent gas jet can be achieved by developing a gas shield that, contrary to the conventional wisdom of the art, has little or no vector flow at the interface with the gas jet, except for the vector flow imparted to it by the gas jet itself. In other words, the gas shroud is not introduced in a particular flow pattern, such as described by the references cited above, but instead is introduced as a cushion of gas surrounding the gas jet as it issues from the jet orifice, so that the flow dynamics of the shroud are similar to that which occurs when a gas jet is issued directly into the ambient atmosphere.

According to our invention a turbulent jet of gas is produced issuing from an orifice along an axis, and this gas jet as it issues from the orifice is surrounded with an annular cushion of shroud gas of desired composition. This shroud gas is entrained into the gas jet at a given rate, diluting the gas jet, but in a predictable manner, and to the substantial exclusion of any dilution by the ambient atmosphere. To maintain the shroud cushion, the shroud gas is replaced at a rate related to the rate at which it is entrained into the gas jet. Preferably the shroud gas is replaced at a rate at least equal to its entrainment rate.

The shroud cushion can be produced by any suitable means, but preferably it is formed by passing the shroud gas from an annular coaxial manifold volume through porous media into the spray zone downstream from the jet orifice. In this way the shroud gas does not impinge against the gas jet or modify its flow dynamics by a shroud gas flow vector, but merely becomes entrained into the jet in a manner that can be both measured and predicted from known parameters and relationships, thereby greatly simplifying design and scale up of apparatus modifications.

The apparatus of our invention for producing a shrouded gas jet includes (a) gas conduit means terminating in an orifice through which a gas jet can issue along an axis into a spray zone, (b) shroud gas manifold means disposed annularly around the orifice, the manifold means extending from the plane of the orifice to a point downstream thereof, (c) a wall of porous media positioned in a flow path between the manifold means and the spray zone, and (d) means for introducing shroud gas into the manifold. The shroud gas introducing means can be disposed so that the shroud gas enters the manifold tangentially and does not forcibly impinge directly upon the porous media. Such action could, depending upon the size of the pore openings and the force of the introduced shroud gas, cause the shroud gas to contact the gas jet with a vector flow that would alter the flow dynamics of the gas jet, which is one of the prior art characteristics to be avoided.

The process and apparatus of our invention can be used to protect a jet spray from reaction with ambient gases, or to protect an applied coating from oxidation by entrained air, or to meter together two gaseous streams having reactive components, one stream being a jet spray and the other an enveloping shroud which is entrained into the jet stream as it issues from an orifice or nozzle. This can be done without significantly altering the original flow field of the jet stream and without exposure of sensitive parts of the spraying apparatus to reactive materials. In both the protective and metering modes, the composition of the gas jet is controlled in a desired manner as it passes from the jet orifice to a downstream control point selected to best suit the particular application at hand.

IN THE DRAWINGS

DETAILED DESCRIPTION OF THE INVENTION

Figure 3:
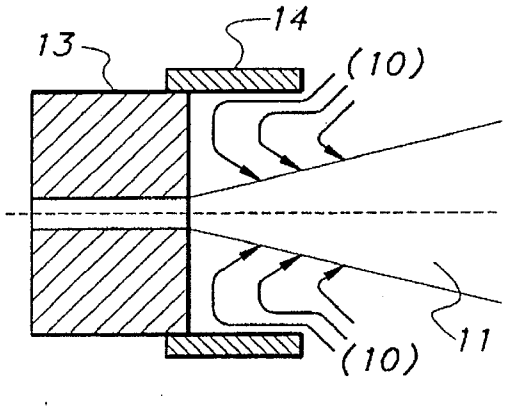
FIG. 3 PRIOR ART
FIGS. 1–3 are schematic illustrations of prior art gas jet nozzles showing ambient air aspiration for various configurations.

One of the features of our invention is that it provides broadly useful method and apparatus for minimizing aspiration of ambient air or other ambient gases into various turbulent gas jets as well as controlling the composition of aspirated gases. In the case of thermal spraying in open air, it can be used to minimize oxidation of sprayed feed materials and just deposited hot coatings or thick preforms by reducing the amount of oxygen aspirated into the jet spray, using inert shrouding gases. In the case of reactive gas thermal spraying, it provides a convenient means for introducing reactive gas or gas containing reactive materials suspended therein into the jet spray.

Our invention provides both method and apparatus for minimizing aspiration of ambient air or other ambient gases into various turbulent gas jets as well as controlling composition of aspirated gases. The jets of interest have high Reynolds numbers as calculated from the following formula:

$$Re=D_j*u*\rho/\mu$$

where: Re is the Reynolds number, $D_j$ is the jet nozzle orifice diameter, u is the exit velocity of the jet, $\rho$ is the density of the jet gas, and $\mu$ is the viscosity of the jet gas. Our invention is concerned primarily with turbulent gas jets characterized by Reynolds numbers of at least 2000, and preferably 2300 and higher, which are typical in many industrial processes, most notably in the thermal spray coating industry. In the case of thermal spraying operations conducted in open air, the invention minimizes oxidation of sprayed feed materials and just deposited hot coatings or thick preforms by reducing the amount of oxygen aspirated into the spray jet. In the case of reactive gas thermal spraying, the invention can be used to introduce reactive gas into a spray jet without significantly altering the jet's original flow field and without exposing sensitive parts of the spraying gun (for example, tungsten and copper electrodes located upstream of the jet nozzle exit) to this reactive gas.

The practice of our invention takes advantage of the fact that (1) the amount of atmosphere gas aspirated by a turbulent gas jet from surroundings can be determined, and (2) if a "shrouding" gas is supplied directly to the jet surface at the flowrate determined from the characteristic jet aspiration rate, then this shrouding gas will be entrained into the jet while the atmosphere gas will remain largely outside the jet. To be predictable and effective, the shrouding gas should be supplied to the jet surface in the least intrusive way which will not alter the original flow field of the jet. We refer to this as producing a "cushion" or soft flow of the shrouding gas adjacent the jet spray as it issues from the jet orifice. A preferred way of doing this is to pass the shrouding gas from a manifold volume through porous media like metallic foams, filters, or membrane materials arranged around the axis of the jet. In this manner, the required amount of shrouding gas is supplied without disrupting the original flow field of the jet.

The size, surface area, pore number, configuration, and positioning of the porous media discharging the required amount of the shrouding gas are secondary factors as long as the zone between the jet nozzle exit and the edge of the porous media is sealed to prevent back-aspiration of the atmosphere gas so that the first gas that can be aspirated from the surroundings by the expanding jet will be the shrouding gas supplied through the porous media.

The aspiration rate of surrounding gases by a turbulent jet stream can be calculated by equations taken from Beer and Chigier, *Combustion Aerodynamics*, 1972, Halsted Press Division of John Wiley & Sons. Assuming steady state flow of ideal gases to reflect typical conditions in the industrial applications of interest, one can derive an expression for the aspiration flowrate ($Q_s$) as a function of jet flowrate ($Q_j$), both flowrates in standard cubic feet per hour (SCFH), the ratio (r) of ambient gas to jet gas densities determined at 298° K and 1 atmosphere pressure, and a dimensionless standoff distance (b) from the nozzle exit, expressed in orifice diameters, which is the ratio of the length of the standoff distance to the diameter of the jet orifice. The standoff distance is the length along the axis of jet flow from the orifice to the point at which the aspiration rate is evaluated, otherwise referred to as the control point. This can be expressed by the equation:

$$Q_s=Q_j/r\times(k\sqrt{r}\times b-1)$$

wherein k is a constant equal to 0.32. The aspiration flowrate $Q_s$, is the preferred minimum shrouding gas flowrate required for the invention to work most effectively. In other words, the shrouding gas is introduced through the porous media at a rate which corresponds to the rate at which the shrouding gas is aspirated into the jet stream. This shrouding gas flow rate can be somewhat greater than the aspiration rate provided that the shroud gas does not develop a vector flow on its own which disrupts the flow field of the jet stream. If the shroud gas flow rate is less than the aspiration rate $Q_s$, ambient atmosphere gases will be drawn into the jet stream and part of the protective function of the shroud gas will be partly lost.

By further modifying the above equation for $Q_s$, one can predict the oxygen concentration in a given gas jet which is expanding into the open air atmosphere. This equation for oxygen concentration $C_{O2}$ can be expressed as follows:

$$C_{O2}=c_a/[1+r/(k\sqrt{r}\times b-1)]$$

wherein $c_a$ is 20.9%, the oxygen concentration in air. By plotting the ratio of the aspirated gas volume-per-time to jet gas flow rate, $R=Q_s/Q_j$, for a range of ambient gas-to-jet gas density ratios (r) and axial distances from jet nozzle (b) that are encountered in industrial practice in thermal spray-coating, welding, and combustion or oxygen lancing operations, it can be shown that shortening the axial standoff distance from the nozzle exit (b), maximizing the density of the surrounding gas with respect to jet gas (r), and minimizing the temperature difference between the two gases result in a reduction of the ratio of aspirated gas volume to jet gas volume (R). As an example for such calculations, the gas density ratio equals ten (r=10) for He-jet in Ar-environment, r=7.2 for He-jet in air-environment, r=1.03 for $N_2$-jet in air-environment, and r=0.88 for $O_2$-jet in air-environment.

An equation can also be derived to show the effect of hot jet gases or elevated jet temperature (T) on the ratio of aspirated gas volume-per-time to jet gas flowrate (R) and the aspiration flowrate ($Q_{sT}$), respectively:

$$Q_{sT}=Q_j/r\times[k\sqrt{(rT/298)}\times b-1]$$

$$R_T=Q_{sT}/Q_j$$

In these equations, T is the jet gas temperature, in degrees K, at the axial distance b from the orifice, and the relationships can apply to the special case where hot jet enthalpy is lost, for example, via radiation, without preheating the surrounding gas which is aspirated into the jet. The value of $R_T$ is typically from a few percent to a few hundred percent larger than the value of R. Because of thermal exchange occurring between the initially hot gas jet and the cold ambient gas, or a secondary ionization in the case of highly ionized plasma jets, the calculated value of the shroud gas flowrate, $Q_{sT}$, can sometimes exceed the absolute minimum required for an effective shrouding. Nevertheless, the equation for $Q_{sT}$ can be conveniently used to set the preferred minimum shroud gas flowrate required for the invention to work most effectively. It should be also mentioned that for cold gas jets expanding into hot ambient gas atmosphere, the equations for $Q_{sT}$ can be modified by reversing the temperature term "T/298".

In the thermal spray coating practice, the actual shrouding gas flow rate can vary from as low as 0.33 times the calculated aspirated rate to as high as 3 times the calculated rate, either $Q_s$ or $Q_{sT}$. Preferably, however, the shrouding gas flow rate is at least as large as the calculated aspirated rate, and, as explained above, should be at least as large as the actual aspirated rate to avoid drawing atmospheric gases into the jet spray stream.

Figure 2:
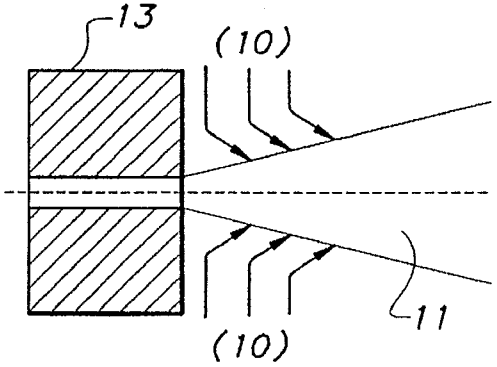
FIG. 2 PRIOR ART
Figure 1:
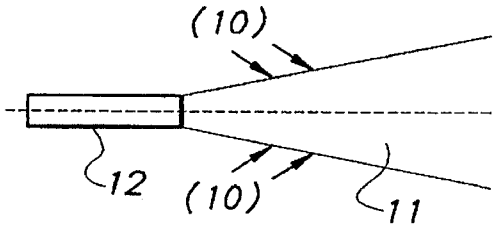
FIG. 1 PRIOR ART

Referring now to the drawings, FIGS. 1, 2 and 3 illustrate schematically prior art in which the ambient atmosphere 10, such as air, is drawn into a gas jet spray stream 11 which issues from a tube 12 in FIG. 1, or from a nozzle head 13 in FIG. 2, or from a nozzle head 13 equipped with a "passive shroud tube" 14 in FIG. 3, the nozzle head and shroud tube being shown in cross section. FIGS. 1 through 3 illustrate the effect of aspiration of ambient gas into a jet of compressed gas expanding from a nozzle. Aspiration into a jet expanding from a tubular nozzle is geometrically unconstrained, FIG. 1. Aspiration into a jet expanding from a flat-faced nozzle is slightly hindered near the nozzle exit since the ambient gas has to change its flow direction, FIG. 2. Aspiration into a jet expanding from the nozzle surrounded by a passive shroud tube is more constrained since the ambient gas is forced to make a U-turn inside the tube before being drawn into the jet, FIG. 3. Overall, the effects of nozzle termination and shroud configuration on the aspiration rate are not significant since as soon as the "vacuum" or low-pressure region created around the nozzle exit is formed it tends to be filled with the ambient gas. According to our invention, such aspiration of atmosphere gases into the gas jet is precluded by supplying a cushion of shrouding gas around the gas jet as illustrated schematically by FIGS. 4–9.

Figure 4:
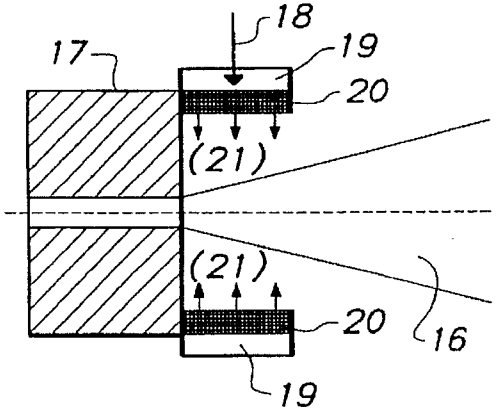

In each of FIGS. 4 through 9, a turbulent gas jet 16 issues from nozzle head 17. Referring to FIG. 4, shrouding gas is introduced through conduit 18 into manifold volume 19 which is an enclosed chamber from which the only outlet is through a wall of porous media 20. The volume 19 and media 20 form a porous, gas permeable, cylinder surrounding gas jet 16 and coaxial therewith. The shroud gas in volume 19 passes through media 20 into the zone surrounding jet 16 and forms a gas cushion 21 from which gas is entrained or aspirated into the jet stream.

Figure 6:
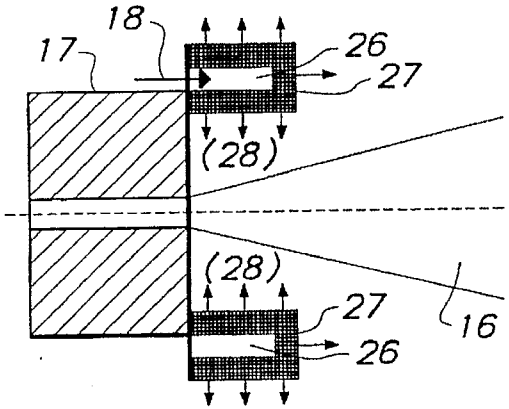
FIGS. 4–9 are schematic illustrations of shrouded gas jet nozzles using the invention in various configurations.
Figure 5:
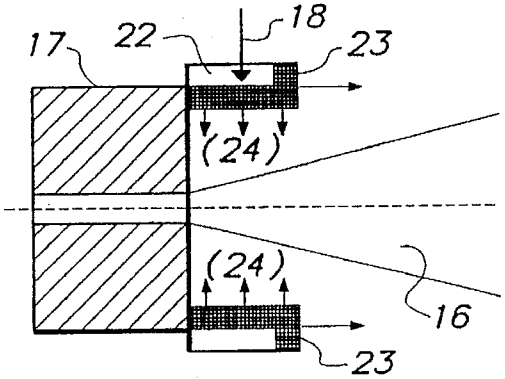

In FIG. 5, shroud gas is passed through conduit 18 into manifold volume 22 and thence through porous media 23 to form shroud gas cushion 24. FIG. 5 illustrates a flanged porous cylinder for producing a gas cushion around jet 16. In FIG. 6, the shroud gas is introduced through conduit 18 into volume 26, from which it passes through a ring 27 of porous media to form gas cushion 28 surrounding jet 16. In this embodiment, an excess of shroud gas may be used to inert the face of the sprayed coating away from the main jet.

Figure 9:
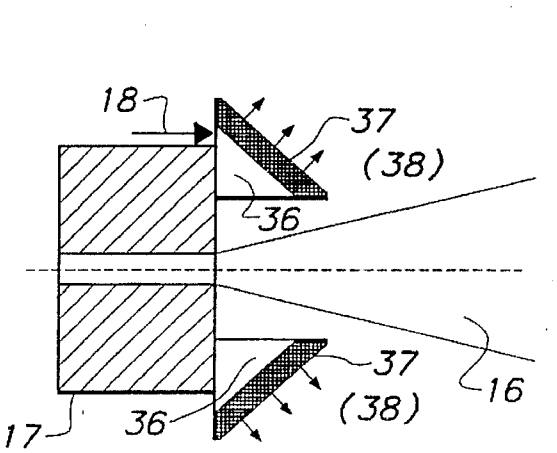
Figure 8:
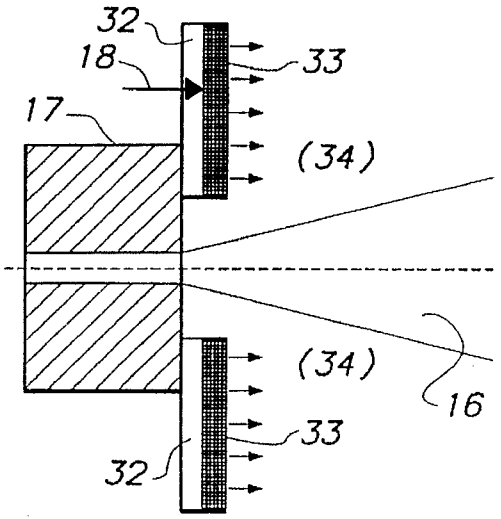
Figure 7:
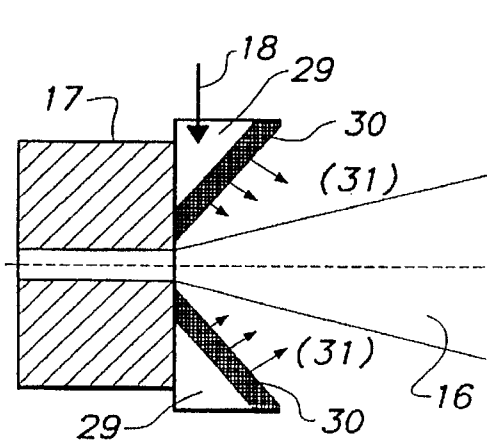

FIG. 7 illustrates a diverging porous cone formed by manifold 29 and porous media 30. Shroud gas supplied through channel 18 passes through the cone to form gas cushion 31 surrounding jet 16. In FIG. 8, the gas jet is encircled by a porous plate formed by manifold 32 and porous media 33. The shroud gas introduced through conduit 18 forms gas cushion 34 to protect jet 16. In FIG. 9 a converging porous cone is shown formed by volume 36 and media 37. The shroud gas passing through conduit 18 into the cone moves on to form gas cushion 38 surrounding jet 16.

FIGS. 4 through 9 show various configurations of the apparatus of our invention which is an "active" shroud attachment. Each type of the active shroud attachment has a porous (gas permeable) wall through which shrouding gas is discharged at a predetermined flowrate into the space surrounding the gas jet and/or nozzle exit.

The porous media can be made of any firm material such as metal or carbon foams or felts, ceramic sponges or any other material which, in the case of applications involving hot jets or hot atmospheres, are able to withstand elevated temperatures. In the case of typical thermal spraying operations, the shrouding gas cooled porous media need only to withstand temperatures not exceeding a few hundred degrees Celsius. The porous element can be a sandwich made of thin metallic, ceramic or carbon meshes as well as a temperature resistant felt, such as Feltmetal® fiber metal of Technetics, Corp. of DeLand, Fla. which is a structure of randomly interlocked metal fibers. The porous element can also be a set of very fine and tightly packed tubes, rods or spheres as well as microscopic and densely spaced holes drilled in a monolithic plate, sheet or cylinder. Membrane materials characterized by open porosity, reticulated or filter materials resistant to elevated temperatures can also be used to practice the invention.

The size and surface area of pores can vary within wide limits as long as the micro-jets formed on discharging the shrouding gas from individual pores of the porous surface are small enough so that they do not interfere with the shrouded gas jet expanding from the nozzle and do not disturb the original flow field of the jet. Pore diameters which are no more than ⅕ of the original jet nozzle diameter ($D_j$) but no less than 0.001 inches can be used without any detrimental effect on shrouding performance. Thus, the preferred number of pores on the surface of the porous element is from 20 to 40 pores per linear inch. The minimum size can be selected on the basis of practical considerations like the shroud gas pressure drop during the passage across the porous element. As an illustration, porous elements described in the Examples were made of three different materials supplied by AstroMet, Inc., Cincinnati, Ohio: a 20-pore/linear-inch copper foam, a 30-pore/linear-inch copper foam, and a 40-pore/linear-inch Ni-38%Cr alloy foam.

FIGS. 4 through 9 illustrate only the most basic configurations within the scope of the invention. FIG. 4 shows a double-wall cylindrical attachment where the inner wall is made of a porous element and the outer wall along with the front and back ring covers are impermeable (gas tight) and constitute a shrouding gas plenum. FIG. 5 shows one modification of the attachment from FIG. 4 where the front ring cover is replaced by a porous surface. This specific configuration is preferred in thermal spray coating applications where a portion of the shrouding gas can be directed toward the coated substrate in order to enhance inerting and shrouding of the fresh and still hot coating resulting in the further reduction of oxide layers forming at the coating surface away from the main spraying jet. FIG. 6 shows a porous ring attachment which can be used for jet shrouding in furnaces or spraying chambers and booths but could be less effective in outdoor applications where wind or strong air drafts prevail. FIGS. 7, 8 and 9 show diverging, planar, and converging shroud attachments, respectively, where the selection of a particular configuration can be dictated by various practical considerations like size compactness or protection from external heat. In all cases, it is important for the effective shroud operation to prevent a back aspiration of the ambient gas between the jet nozzle exit and the porous element discharging the shrouding gas. It is preferred but not essential that the shrouding attachment be symmetrical and coaxial with the gas jet.

Figure 12:
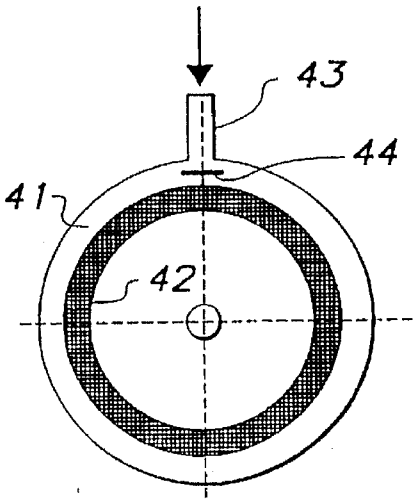
FIGS. 10–12 are cross sectional views of the apparatus of the invention incorporating preferred ways of introducing shrouding gas into the shroud manifold.
Figure 11:
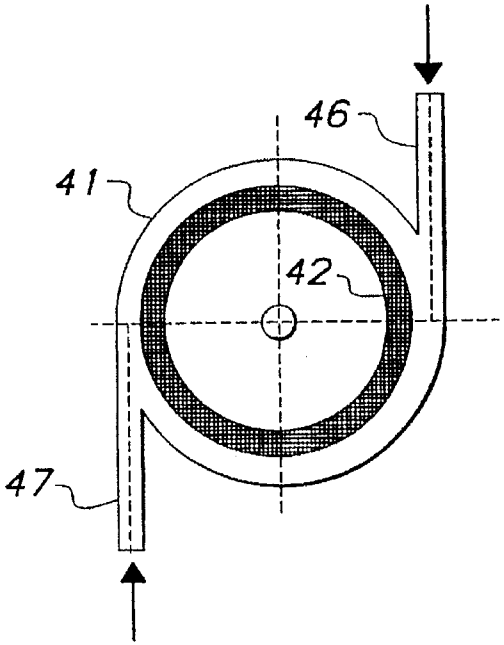
Figure 10:
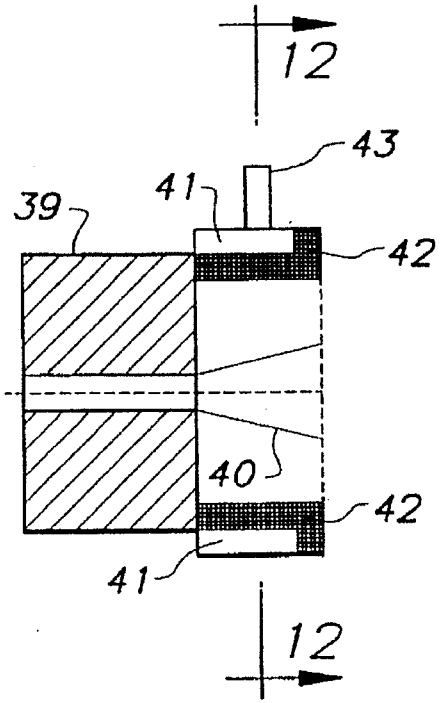

In order to avoid uneven passage of shrouding gas through the porous walls, it is preferred that the shrouding gas be introduced into the shroud manifold or plenum in such a way that the introduced gas does not forcibly impinge directly upon the porous media. Two acceptable ways of achieving this result are illustrated by FIGS. 10, 11 and 12. Referring to FIG. 10, a nozzle 39 is shown in cross section from which issues a jet spray 40. Surrounding spray 40 is a manifold volume 41 having walls 42 of porous media. Shrouding gas is introduced into volume 41 through conduit 43. FIG. 12 is a sectional view of the manifold and conduit along line 12—12. In FIG. 12 conduit 43 is positioned for radial entry into volume 41 so that the shroud gas impinges on baffle 44 rather than against porous media 42. Alternatively, FIG. 11 shows a preferred way to introduce shroud gas into volume 41 by tangential entry of conduits 46 and 47, thus also avoiding direct impingement by the shrouding gas on the porous media.

FIGS. 10, 11 and 12 illustrate only two of many possible ways of introducing shrouding gas into the plenum of the shroud attachment. In order to produce the most uniform pressure and flow distribution around the shrouded jet (in the gas cushion which is formed on the jet side of the porous element), it is desirable to avoid direct impingement of the incoming shrouding gas on the porous surface. In addition to the ways illustrated by FIGS. 10–12, direct impingement on the porous media can be avoided by coaxial and counter-flow injection of shrouding gas into the plenum. A 2-tangential injector configuration as shown in FIG. 11 was used in the Examples.

Figure 14:
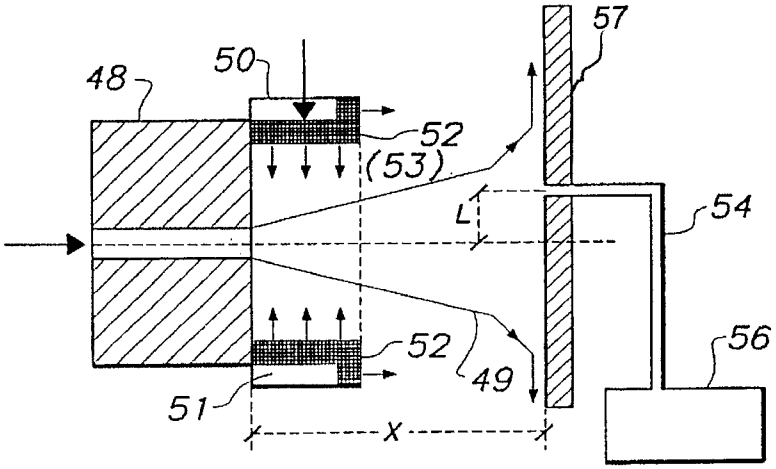
FIGS. 13 and 14 are schematic representations of sampling techniques for detecting gas jet compositions at a control point downstream of a nozzle shrouded according to the invention.
Figure 13:
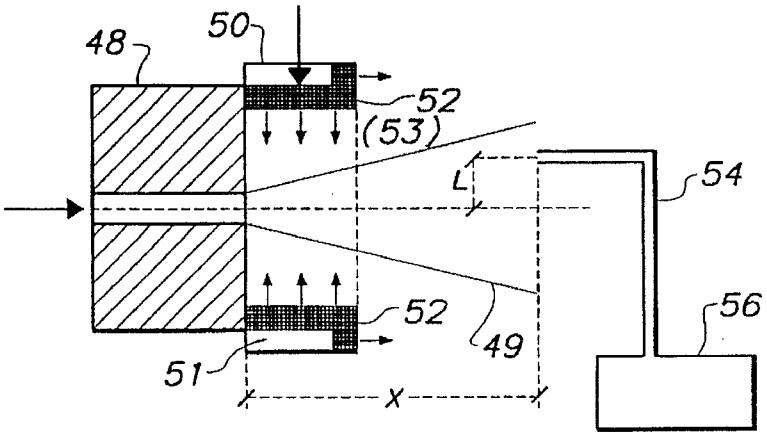

FIGS. 13 and 14 show "free jet" and "stagnated jet" configurations, respectively, tested in the Examples. The free and the stagnated jet configurations correspond to the industrial processes involving expansion of gas jets into open atmospheres or furnace chambers and thermal jet treatment, melting, cutting, welding, or spraying of solid and liquid onto substrate surfaces. Since the majority of the runs were based on jetting a noble gas in a shroud of nitrogen into ambient air, an oxygen analyzer with a gas sampling pump were used to measure both shrouding and air aspiration effects. In each case, a needle-shaped oxygen sampling tube was positioned at a precisely determined axial distance (X) and radial distance (L) from the nozzle exit, thus defining the control point. For hot plasma jets, the oxygen tube was made of a high-temperature ceramic material with a Pt-PtRh thermocouple attached.

Referring to FIG. 13, a nozzle 48 is shown emitting a gas jet spray 49. The jet is surrounded by a coaxial cylindrical shroud 50 having a manifold 51 and a porous wall section 52. Shroud gas passing through porous wall section 52 forms a gas cushion 53 adjacent jet 49. The composition of the jet stream containing aspirated shroud gas is determined from a sample of the stream taken by probe 54 leading the sample to oxygen analyzer 56. The position of the sample taken by the probe is at a distance X along the axis of the jet stream and at a radial distance L spaced from the axis. From such a device it is possible to determine the amount of oxygen aspirated into the free gas jet from the ambient air atmosphere as a function of shrouding gas flow rate.

FIG. 14 shows the same shrouded gas jet nozzle associated with a gas sampling probe and oxygen analyzer as in FIG. 13 but with an added substrate wall 57 onto which a coating is applied by the gas jet. This device enables the determination of oxygen aspirated into a gas jet that is stagnated on a substrate wall as a function of shrouding gas flow rate.

Figure 15:
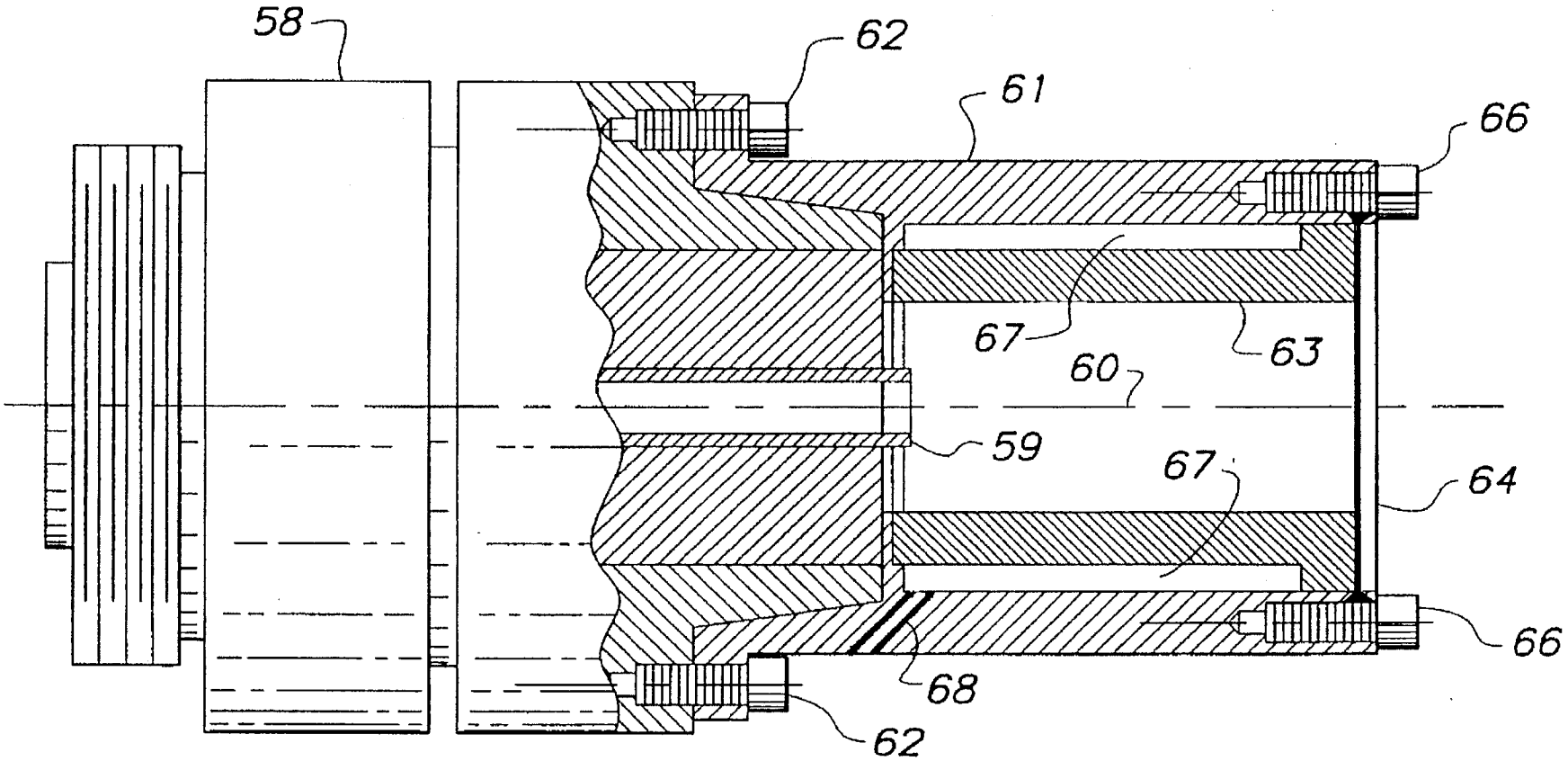
FIG. 15 is a view in partial cross section of a nozzle equipped with a porous shroud according to a preferred embodiment of the invention.

One embodiment of the apparatus for our invention is illustrated in FIG. 15. The apparatus is shown in partial cross section. Gas jet nozzle 58 has an orifice 59 from which a turbulent gas jet spray can be emitted along axis 60 which is also the axis of symmetry for the orifice and nozzle. Mounted on the face of nozzle 58 is cylindrical shroud 61 positioned coaxially around the orifice and extending from the orifice to a point downstream thereof. Shroud 61 is secured to nozzle 58 by bolts 62. Cylindrical porous wall section 63 is mounted coaxially as an insert within shroud 61 and also extends from the orifice 59 to a point downstream thereof. Porous cylinder 63 is designed so that its inner surface is spaced from orifice 59 and its spray zone and is held in place by retaining ring 64 secured to shroud 61 by bolts 66. Shroud 61 and cylindrical porous wall section 63 cooperate to define a cylindrical volume 67 which is in flow communication with the pores of cylindrical porous wall section 63 throughout its length. Entry port 68 is located tangentially within volume 67 for introduction of shrouding gas into volume 67. The shrouding gas then passes through wall section 63 to form a cushion of gas around the jet stream emitting from orifice 59.

Other advantages and features of our invention will be apparent to those skilled in the art from the following examples which am illustrative only and should not be construed to limit our invention unduly.

EXAMPLE 1

Equations for $Q_s$ and $C_{O2}$, given above, were used to predict oxygen concentration in nitrogen and helium jets expanding from a nozzle (such as shown in FIGS. 1 and 2) into air and to estimate shrouding gas requirement for the same jets. Calculations were made for a nozzle diameter of 0.25 inches, axial standoff distance from nozzle exit of 3 inches (typical in many plasma spraying operations), and nitrogen or helium jets each expanding at a flowrate of 700 SCFH. Referring to the jet configuration shown in FIGS. 1 and 2, oxygen concentration predicted for a nonshrouded nitrogen jet was 15.4 volume percent. Oxygen concentration predicted for a nonshrouded helium jet was 11.7 volume percent. It was further assumed that nitrogen is the shrouding gas for the jets. In the case of the nitrogen jet, the aspiration rate, and consequently shrouding nitrogen requirement, was predicted to be 1962 SCFH (2.8 times more than the original flowrate of the jet). In the case of the helium jet the aspiration rate, and consequently shrouding nitrogen requirement, was predicted to be 900 SCFH (1.3 times more than the original flowrate of the jet). The results showed the effect of the ambient gas-to-jet gas density ratio (r) on the jet aspiration rate (R), namely, the higher the density ratio (r), the lower the aspiration rate (R). The data obtained from actual runs reported in Example 2 confirm this effect.

COMPARATIVE EXAMPLE 2

Effects of configuration and size of the shroud as well as type of jet gas used were measured for free and stagnated jets at room temperature according to the test set-up shown in FIGS. 13 and 14 and the conditions specified in Example 1 for both nitrogen and helium gas jets. The substrate wall in the set-up for a stagnated jet (FIG. 14) was 1 foot square. The jets were turbulent with Reynolds numbers much higher than the minimum value of 2000. No shrouding gas was used in this series of runs. Oxygen concentrations in the gas jet at the axial standoff distance of 3 inches are given in Table 1 for the various gas jet and "passive" shroud types.

TABLE 1

| Run Number | Jet Gas | Jet Type | Nozzle and Shroud Configuration | Shroud I.D. by Shroud Length: inches | Oxygen Conc.: vol. % |
|---|---|---|---|---|---|
| 1 | nitrogen | free | FIG. 2 | none | 14.8* |
| 2 | nitrogen | free | FIG. 3–6 | 2.00 × 1.33 | 13.9 |
| 3 | nitrogen | free | FIG. 3–6 | 1.26 × 1.33 | 14.0 |
| 4 | nitrogen | stagnated | FIG. 2 | none | 13.9 |
| 5 | nitrogen | stagnated | FIG. 3–6 | 1.26 × 1.33 | 12.9 |
| 6 | helium | free | FIG. 3–6 | 1.26 × 1.33 | 8.2** |
| 7 | helium | stagnated | FIG. 2 | none | 8.7 |
| 8 | helium | stagnated | FIG. 3–6 | 1.26 × 1.33 | 7.2 |

*In Example 1 the oxygen is predicted to be 15.4 vol. % for nonshrouded free jet.

**In Example 1 the oxygen is predicted to be 11.7 vol. % for nonshrouded free jet.

Oxygen concentration measured in a free nonshrouded nitrogen-jet configured as shown in FIG. 2 was found to be 14.8 volume percent, which is very close to the concentration of 15.4 volume percent predicted in Example 1 for the jet configuration shown in FIGS. 1 and 2. Oxygen concentration measured in a free nitrogen-jet expanding from a "passive tube" shrouded nozzle (shown in FIG. 3) was found to be 13.9 volume percent. This is a very small drop from the 14.8 volume percent measured for the free nonshrouded jet indicating that the aspiration of ambient air cannot be significantly reduced by a passive means alone. Oxygen concentration measured in the free nitrogen-jet expanding from the nozzle surrounded by the porous shroud attachment was found to be 14.0 volume percent. The shroud attachment used in this test is shown in FIGS. 4–6 but no shrouding gas was used. Its internal diameter was somewhat smaller than the internal diameter of the passive tube from FIG. 3. Stagnation of nitrogen-jets on a substrate wall was found to reduce oxygen concentration at the 3-inch standoff distance by about 1 volume percent as compared to the free jets. This effect is insignificant as far as industrial applications are concerned.

In Run 6, the oxygen concentration measured in a free helium-jet configured as shown in FIGS. 3–6 was found to be 8.2 volume percent which is less than the concentration of 11.7 volume percent predicted in Example 1 for the configuration shown in FIGS. 1 and 2. The observed discrepancy is most likely the result of the wide nozzle head 13 used in the experiment and the "passive" shroud effect; predictive equations for $Q_s$ and $C_{O2}$ neglect the width of the nozzle head or the tube 12. It is noted that although the equation for $C_{O2}$ overpredicts oxygen concentration in helium-jets, it is still very useful in predicting the scale of oxygen entrainment. Stagnation of helium-jets on a substrate wall was found to either reduce oxygen concentration at the 3-inch standoff distance by about 1 volume percent as compared to the free helium-jets or to maintain the original concentration within the range of experimental error. As in the case of nitrogen-jets, this effect is insignificant from an industrial standpoint. Importantly, the overall effect of gas density ratio (r) on jet aspiration ratio (R) calculated in Example 1 is confirmed by comparing the measured concentrations of oxygen in the nitrogen- and the helium-jets.

EXAMPLE 3

Effects of shrouding gas flowrate, shroud configuration, porous element, and type of jet gas used were measured for free and stagnated nitrogen and helium jets at room temperature according to the test set-ups shown in FIGS. 13 and 14 and at the conditions specified in Examples 1 and 2. In the stagnated jet runs the jet stream impinged against a wall. Flowrates of nitrogen used as the shrouding gas at 298° K were varied from 0 SCFH to 2500 SCFH at 500 SCFH increments. The shrouding tube used in these runs had two tangential nitrogen injection ports as shown in FIG. 11. Run 1 used a shroud as shown in FIG. 3, having an I.D. of 2.0 inches and a length of 1.33 inches. Runs 2 through 5 used a shroud according to the invention having a porous cylinder insert with an I.D. of 1.26 inches and a length of 1.33 inches. Oxygen concentrations as volume percent of the jet gas streams at the sample point for the various shrouding arrangements and shrouding gas flow rates are given in Table 2.

TABLE 2

| Run | Jet | | | Oxygen Concentration: vol. % Shroud Gas Flow Rates: SCFH | | | | | |
|---|---|---|---|---|---|---|---|---|---|
| No. | Type | Jet Gas | Shroud | 0 | 500 | 1000 | 1500 | 2000 | 2500 |
| 1 | free | nitrogen | FIG. 3 | 13.9 | 16.5 | 13.5 | 12.0 | 13.0 | 12.5 |
| 2 | free | nitrogen | FIG. 5 | 14.0 | 8.9 | 5.8 | 3.0 | 1.9 | 2.1 |
| 3 | stagn. | nitrogen | FIG. 5 | 12.9 | 7.5 | 3.7 | 1.9 | 1.1 | 0.9 |
| 4 | free | helium | FIG. 5 | 8.2 | 1.8 | 0.5 | 0.4 | 0.6 | 0.5 |
| 5 | stagn. | helium | FIG. 5 | 7.2 | 1.8 | 0.4 | 0.2 | 0.1 | 0.0 |

Oxygen concentration measured in the free nitrogen-jet expanding from the shroud configured as shown in FIG. 3 (no porous element inserted into the shroud) was found to vary randomly between 12 volume percent and 16.5 volume percent regardless of the shrouding gas flowrate used. Clearly, this shroud configuration was ineffective since the shrouding nitrogen was spun away from the jet rather than aspirated by the jet.

Oxygen concentration measured in the free nitrogen-jet (FIG. 13) expanding from the shroud configured as shown in FIG. 5 (with the porous element shaped like a flanged cylinder) (Run 2) was found to decrease logarithmically from 14 volume percent to 1.9 volume percent as the shrouding gas flowrate increased from 0 SCFH to 2000 SCFH. The further increase in the shrouding gas flowrate to 2500 SCFH resulted in a slight increase in oxygen concentration to 2.1 volume percent. Thus the actual optimum shroud gas flowrate value of 2000 SCFH is very close to the value of 1962 SCFH predicted by calculation of ambient gas aspiration rate for the same basic conditions in Example 1. Runs 1 and 2 showed (a) that the use of a porous element for discharging shrouding gas around a turbulent gas jet is critical, and (b) that the equation for aspirated gas flowrate $Q_s$ when used for porous shrouding systems offers a surprisingly accurate prediction for optimum shrouding gas flowrate.

Oxygen concentration measured in the stagnated nitrogen-jet (FIG. 14) expanding from the shroud configured as shown in FIG. 5 (with porous element shaped like a flanged cylinder) (Run 3) was found to decrease logarithmically from 12.9 volume percent to 0.9 volume percent as the shrouding gas flowrate increased from 0 SCFH to 2500 SCFH. This concentration change with shrouding gas flowrate is very similar to the one observed for the free nitrogen-jet. The oxygen concentration curve for the stagnated jet was somewhat below the curve for the free nitrogen-jet which is consistent with the observations for Example 2.

The same general observations were made for the runs measuring oxygen concentration in the free and stagnated helium-jets (Runs 4 and 5). It is, however, noteworthy that the oxygen concentration in helium-jets dropped below 0.9 volume percent for a nitrogen-shroud flowrate of 1000 SCFH. This value is in surprisingly good agreement with the value of 900 SCFH shroud gas flowrate predicted by calculation of ambient gas aspiration rate for helium-jets in Example 1.

EXAMPLE 4

The effects of radial distance from the jet axis and shrouding gas flowrate on oxygen concentration were measured for free and stagnated nitrogen- and helium-jets at room temperature according to the test set-up shown in FIGS. 13 and 14 and at the conditions specified in Examples 1 and 2. Two shrouding nitrogen flowrates were selected: 1400 SCFH nitrogen for the helium-jet (which is 155% of the $Q_s$ flowrate value of 900 SCFH for a helium-jet, calculated from the equation for $Q_s$ in Example 1) and 2150 SCFH for the nitrogen-jet (which is 110% of the $Q_s$ flowrate value of 1962 SCFH for the nitrogen-jet calculated in Example 1 from the equation for $Q_s$). The shrouding nitrogen was at 298° K. The shroud configuration used the flanged porous cylinder insert as illustrated by FIG. 5 with an I.D. of 1.26 inches and a length of 1.33 inches.

Gas jet streams were sampled at the standoff distance X of 3.00 inches along the jet axis and at various radial distances L from the jet axis as illustrated by FIGS. 13 and 14. The samples were analyzed for oxygen concentration and the values are reported in Table 3 as volume percent for the various radial distances and different jet shrouding configurations. These measurements indicate the diameter of a cross section of the jet stream at the standoff distance which has a low oxygen level and therefore optimum protection from oxidation.

TABLE 3

| Run | Jet | | Shroud Present and | Oxygen Concentration: vol. % Radial Distance from Jet Axis: inches | | | | |
|---|---|---|---|---|---|---|---|---|
| No. | Type | Jet Gas | Config. | 0.00 | 0.25 | 0.50 | 0.75 | 1.00 |
| 1 | free | nitrogen | yes FIG. 5 | 1.5 | 2.5 | 7.0 | 14.5 | 19.0 |
| 2 | stagn. | nitrogen | none FIG. 2 | 13.9 | 14.1 | 14.9 | 15.5 | 16.3 |
| 3 | stagn. | nitrogen | yes FIG. 5 | 1.1 | 1.1 | 1.4 | 2.1 | 2.9 |
| 4 | free | helium | yes | 0.3 | 1.0 | 4.3 | 10.4 | 15.1 |

TABLE 3-continued

| Run No. | Jet Type | Jet Gas | Shroud Present and Config. | Oxygen Concentration: vol. % Radial Distance from Jet Axis: inches 0.00 | 0.25 | 0.50 | 0.75 | 1.00 |
|---|---|---|---|---|---|---|---|---|
| 5 | stagn. | helium | FIG. 5 none | 8.7 | 8.9 | 9.5 | 10.5 | 11.3 |
| 6 | stagn. | helium | FIG. 2 yes FIG. 5 | 0.8 | 0.9 | 1.0 | 1.1 | 1.2 |

The diameter of a low-oxygen jet cross-section at the 3-inch standoff distance was found to be approximately 0.5 inches (twice the radial distance) for the shrouded nitrogen- and helium-free jets (runs 1 and 4). In dimensionless terms, the diameter was equal to two nozzle exit diameters ($D_j$) at the axial distance of twelve nozzle diameters. This low oxygen diameter increased to more than 2 inches for the shrouded and stagnated nitrogen- and helium-jets (runs 3 and 6). Oxygen concentrations measured in the nonshrouded nitrogen- and helium-jets were unacceptably high for both the nitrogen- and helium-stagnated jet conditions. More importantly, however, the measured diameters of jet cross-sections that were effectively shrouded by the porous shroud and gas cushion are sufficiently large to enable the invention to be used in reactive jetting, flaming, or reactive spraying applications.

EXAMPLE 5

The effects of shrouding nitrogen flowrate on oxygen concentration were measured for free helium-plasma jets shrouded using the porous shroud attachment configured as shown in FIG. 5. Hot helium-plasma jets flowing at 700 SCFH were generated using a Metco-plasma gun 3MB equipped with a high-velocity nozzle apparatus designed and described by Sokol et al. in U.S. Pat. No. 4,256,779. A helium powder carrier gas at 298° K was added at 20 SCFH. The shrouding gas was nitrogen at 298° K and the porous cylinder shroud had an I.D. of 1.26 inches and a length of 1.33 inches. The test set-up was that shown in FIG. 13 and the other conditions were the same as specified in Example 1. Oxygen concentrations in the jet stream at the standoff distance were measured for plasma currents of 500 and 800 amperes at various shrouding gas flowrates and the results are given in Table 4.

TABLE 4

| Shroud Flowrate: SCFH | Oxygen Concentration in Plasma:vol. % 500 Amperes | 800 Amperes |
|---|---|---|
| 400 | 5.60 | |
| 1100 | 1.25 | |
| 1756 | 0.77 | |
| 2195 | 0.50 | 0.27 |
| 2414 | 0.41 | |
| 2634 | 0.32 | |
| 2853 | 0.27 | |
| 3300 | 0.25 | 0.21 |

The resultant oxygen concentration dropped with increasing nitrogen shroud flowrate in the same way as in Example 3; however, more shrouding nitrogen was needed for the hot helium-plasma jet than for the cold helium-jet (at 298° K) to achieve the same low oxygen concentrations. A slightly lower oxygen concentration resulted from increasing the plasma arc current from 500 amps to 800 amps which is explained by the initiation of a secondary ionization of the nitrogen-shroud gas at the fringes of the helium-jet. The 500 amps jet temperature was measured at the axis 3 inches away from the nozzle exit using a Pt-PtRh thermocouple and found to be 1214 degrees Kelvin. From this thermal data, the minimum shrouding nitrogen flowrate was calculated using the equation for $Q_{sT}$, given above, and found to be 2005 SCFH. Interpolation of experimental data showed that at the 2005 SCFH shrouding nitrogen flowrate, oxygen concentration in the plasma jet was well below 0.75 volume percent. This confirmed the predictive power of the equation for $Q_{sT}$ as well as the usefulness of the invention in high-temperature applications. It is also noted, that as the shrouding gas flowrates increased to values which reduced oxygen concentration in the jet stream at the sample point to values below 1.0 volume percent, oxygen concentration curves characterizing the cold jet and the hot/plasma jet converged. Thus, an oxygen concentration curve plotted from data of Example 3 for a cold helium-jet, converges with an oxygen concentration curve plotted for the helium-plasma jets at the nitrogen-shroud flowrates exceeding 2000 SCFH. This shows that the shrouding method and the shrouding gas flowrate prediction are sufficiently reliable even in the case of uncertainty introduced by estimates of gas jet temperatures.

Our invention takes advantage in a unique way of the self-aspiration of shroud gas by an expanding gas jet. For maximum benefit, shrouding gas should be supplied to the zone surrounding the jet nozzle exit and jet fringes at a flowrate equal to or higher than the natural jet aspiration rate. The above description provides formulas for predicting this aspiration rate. A principal feature of the apparatus of the invention is a porous media wall which can "softly" discharge shrouding gas around the nozzle exit and jet fringes thereby forming a gas cushion which is replaced at the predicted (or higher) flowrate in a way which doesn't disturb the original (nonshrouded) flow field of the jet and doesn't change the natural jet aspiration characteristics. This achieves a highly beneficial result in a manner heretofore unavailable in the art.

Other embodiments of our invention will be apparent to those skilled in the art from the foregoing disclosure without departing from the spirit or scope of the invention.

We claim:

1. A method of shrouding a gas jet in order to control its composition at a point downstream which comprises:

(a) producing a turbulent jet of gas issuing from an orifice along an axis to a control point, (b) surrounding said gas jet as it issues from said orifice with an annular cushion of shroud gas which is entrained at a given rate into said gas jet, and (c) replacing said shroud gas at a rate related to said rate at which it is entrained.

2. The method of claim 1 wherein said shroud gas is replaced at a rate equal to from 0.33 to 3 times said entrainment rate.

3. The method of claim 1 wherein said cushion of shroud gas is vectorless at the interface between said cushion and said gas jet except for the vector imparted by said jet as it entrains said shroud gas.

4. The method of claim 1 wherein said shroud gas is replaced at a rate at least as high as said rate of entrainment.

5. The method of claim 1 wherein said cushion of shroud gas is produced by passing the shroud gas from an annular coaxial manifold volume through porous media positioned in the flow path between said volume and said gas jet.

6. The method of claim 1 wherein said gas jet carries particles of coating material to be applied to a surface against which said jet impinges at said control point and said shroud gas is an inert protective gas.

7. The method of claim 1 wherein said shroud gas contains at least one reactive component which reacts after contact with said gas jet.

8. The method of claim 7 wherein the compositions of said gas jet as it issues from the orifice and of said shroud gas are controlled so that said entrainment rate produces a reactive mixture of desired composition at said control point.

9. The method of claim 5 wherein said shroud gas is introduced tangentially into said manifold volume so as not to impinge forcibly directly on said porous media.

10. The method of claim 2 wherein said turbulent gas jet has a Reynolds number of at least 2000.

11. The method of claim 10 wherein said shroud gas entrainment rate is taken as a value equal to the value of $Q_s$ in SCFH as determined by the formula:

$$Q_s=Q_j/r\times(k\sqrt{r}\times b-1)$$

wherein $Q_j$ is the gas jet flowrate in SCFH, r is the ratio of the density of the shroud gas to the density of the jet gas measured at 298° K and 1 atmosphere of pressure, b is the dimensionless distance along the gas jet axis from the orifice to said control point stated in orifice diameters, and k is a constant equal to 0.32.

12. The method of claim 10 wherein said gas jet is hot and said shroud gas entrainment rate is taken as a value equal to the value of $Q_{sT}$ in SCFH as determined by the formula:

$$Q_s=Q_j/r\times(k\sqrt{(rT/298)}\times b-1)$$

wherein $Q_j$ is the gas jet flowrate in SCFH, r is the ratio of the density of the shroud gas to the density of the jet gas measured at 298° K and 1 atmosphere of pressure, T is the temperature of the jet gas in °K at the axial distance b from the orifice, b is the dimensionless distance along the gas jet axis from the orifice to said control point stated in orifice diameters, and k is a constant equal to 0.32.

* * * * *